United States Patent [19]

Landa et al.

[11] Patent Number: 4,984,025

[45] Date of Patent: Jan. 8, 1991

[54] IMAGING SYSTEM WITH INTERMEDIATE TRANSFER MEMBER

[75] Inventors: Benzion Landa, Edmonton, Canada; Amiran Lavon, Bat Yam, Israel; Hanna Pinhas, Holon, Israel; Yossi Adam, Rehovot, Israel

[73] Assignee: Spectrum Sciences B.V., AE Rotterdam, Netherlands

[21] Appl. No.: 306,065

[22] Filed: Feb. 6, 1989

[51] Int. Cl.[5] ..... G03G 15/16

[52] U.S. Cl. ..... 355/274; 355/271; 355/273

[58] Field of Search ..... 355/256, 273, 274, 271, 355/272, 276, 277; 385/275

[56] References Cited

U.S. PATENT DOCUMENTS

| | | | |
|---|---|---|---|
| 3,657,103 | 4/1972 | Fisher et al. | 204/299 |
| 3,684,364 | 8/1972 | Schimidlin . | |
| 3,702,482 | 11/1972 | Dolcimascolo et al. | 355/274 X |
| 3,741,643 | 6/1973 | Smith et al. . | |
| 3,767,300 | 10/1973 | Brown et al. . | |
| 3,832,055 | 8/1974 | Hamaker . | |
| 3,847,478 | 11/1974 | Young . | |
| 3,863,603 | 2/1975 | Buckley et al. . | |
| 3,893,761 | 7/1975 | Buchan et al. . | |
| 3,955,533 | 5/1976 | Smith et al. . | |
| 3,957,016 | 5/1976 | Yamada et al. . | |
| 3,959,574 | 5/1976 | Seanor et al. . | |
| 4,039,257 | 8/1977 | Connolly . | |
| 4,286,039 | 8/1981 | Landa et al. . | |
| 4,325,627 | 4/1982 | Swidler et al. . | |
| 4,341,455 | 7/1982 | Fedder | 355/274 |
| 4,348,098 | 9/1982 | Koizumi | 355/274 |
| 4,453,820 | 6/1984 | Suzuki | 355/273 X |
| 4,460,667 | 7/1984 | Landa | 355/274 |
| 4,482,242 | 11/1984 | Moraw et al. . | |
| 4,557,583 | 12/1985 | Percic et al. . | |
| 4,571,059 | 2/1986 | Huss . | |
| 4,588,279 | 5/1986 | Fukuchi et al. | 355/277 |
| 4,684,238 | 8/1987 | Till et al. . | |
| 4,690,539 | 9/1987 | Radulski et al. . | |
| 4,708,460 | 11/1987 | Langdon | 355/271 |
| 4,794,651 | 12/1988 | Landa et al. . | |

FOREIGN PATENT DOCUMENTS

| | | |
|---|---|---|
| 58-44472 | 3/1983 | Japan . |

*Primary Examiner*—A. T. Grimley
*Assistant Examiner*—Thu Anh Dang
*Attorney, Agent, or Firm*—Sandler, Greenblum & Bernstein

[57] ABSTRACT

Apparatus for image transfer including an image bearing surface and an image receiving surface arranged for relative movement along a pathway whereby portions of the image bearing surface and the image receiving surface sequentially come into propinquity for image transfer therebetween and subsequently move out of propinquity following image transfer therebetween, potential impression device associated with at least one portion of at least one of the image bearing surface and the image receiving surface for impressing a potential on the at least one portion, and device for energizing the potential impression device only when the at least one portion is located at a predetermined location along the pathway, thereby to provide desired image transfer enhancement.

36 Claims, 11 Drawing Sheets

FIG.8
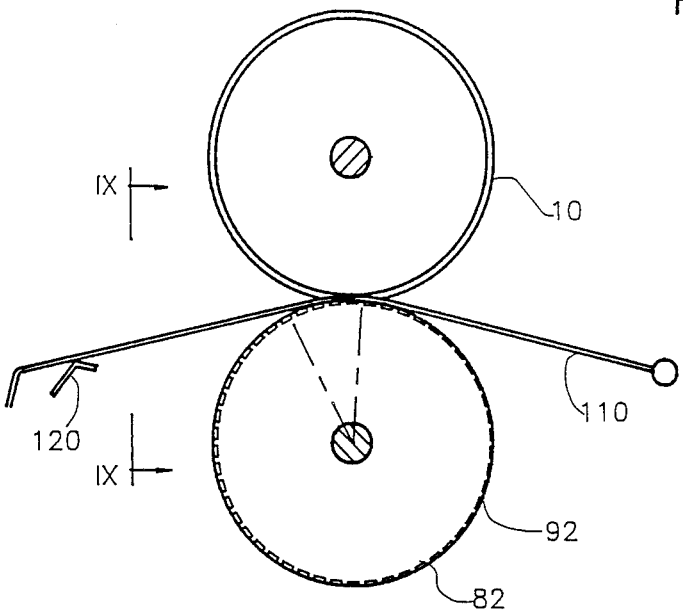
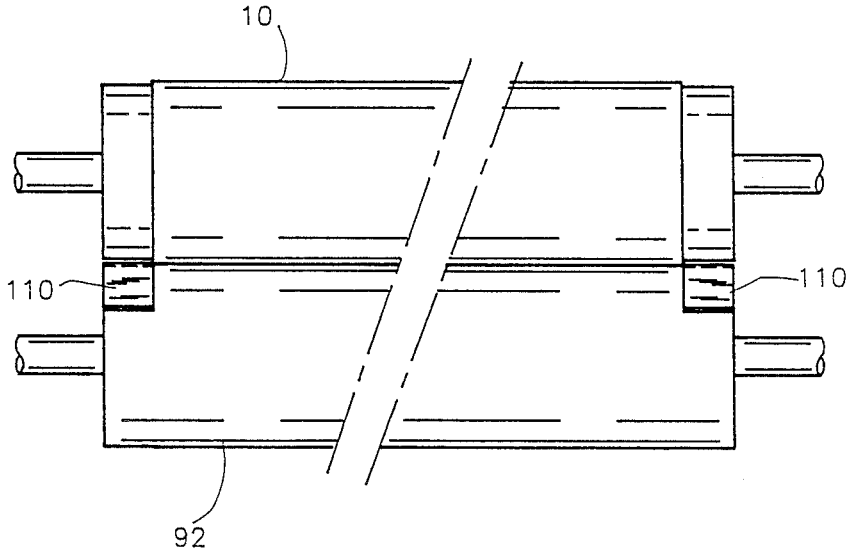
FIG.9

IMAGING SYSTEM WITH INTERMEDIATE TRANSFER MEMBER

FIELD OF THE INVENTION

The present invention relates to image transfer techniques and apparatus for use in electrophotography.

BACKGROUND OF THE INVENTION

Liquid toner images are developed by varying the density of pigmented solids in a developer material on a latent image bearing surface in accordance with an imaged pattern. The variations in density are produced by the corresponding pattern of an electric field extending outward from the latent image bearing surface, which is configured by the different latent image and background voltages on the latent image bearing surface and a voltage on a developer plate or roller.

In general, developed liquid toner images are neither solid nor homogeneous. Typically, a liquid toner developer contains about 1.5% to 2% solids and a developed image contains about 15%-25% solids. The developed image has a higher density closer to the latent image bearing surface and a "fluffy", i.e. loosely bound, region furthest away from the latent image bearing surface.

In order to improve transfer of a clean developed image from the latent image bearing surface to a substrate it is most desirable to ensure that, before transfer, the pigmented solids adjacent background regions are substantially removed and the density of pigmented solids in the developed image is increased, thus compacting or rigidizing the developed image. The compacting or rigidizing of the developed image increases the image viscosity and enhances the ability of the image to maintain its integrity under the stresses encountered during image transfer. It is also desirable that excess liquid be removed from the latent image bearing surface before transfer.

It is known in the prior art, as described in U.S. Pat. No. 3,955,533, to employ a reverse roller spaced about 50 microns from the latent image bearing surface to shear off the carrier liquid and pigmented solids in the region beyond the outer edge of the image and thus leave relatively clean areas above the background.

The technique of removing carrier liquid is known generally as metering. An alternative metering technique, described in U.S. Pat Nos. 3,767,300 and 3,741,643, employs an air knife, but has not been particularly successful due to sullying of the background as a result of turbulence and consequent mixing of the background inversion layer with the surface layer of the carrier liquid.

In U.S. Pat. No. 3,957,016, the use of a positive biased metering roller is proposed wherein the metering roller is maintained at a voltage intermediate the image and background voltages to clean the background while somewhat compacting the image.

In the prior art it is known to effect image transfer wherein the image is brought into contact with a substrate backed by a charged roller. Unless the image is rigidized before it reaches the nip of the latent image bearing surface and the roller, image squash and flow may occur. This is particularly true if the substrate is a non-porous material, such as plastic.

In the prior art, liquid toner images are generally transferred to substrates by electrophoresis, whereby the charged image moves from the latent image bearing surface to the substrate through the carrier liquid under the influence of an electric field produced by a high voltage, associated with the substrate, which is of opposite polarity to the charge on the image particles.

The voltage and thus the field strength available for electrophoretic transfer are limited by the danger of electrical breakdown which can occur at both the input and output edges of the nip, due to the minimum of the Paschen curve being at about 8 microns. Thus, according to the Paschen curve, the voltage difference at the nip cannot exceed about 360 volts, if possible damage to the image and possible damage to the latent image bearing surface due to electrical breakdown are to be avoided.

Electrophoretic compaction of images prior to transfer thereof is described in U.S. Pat. No. 4,286,039 which shows a metering roller followed by a negatively biased squeegee roller. The squeegee roller is operative both for compacting of image and for removing excess liquid. The voltage that can be applied to the squeegee roller is also limited by the danger of electrical breakdown. The breakdown problem is least serious at the input to the squeegee roller since the meniscus present there acts to increase the minimum effective air gap. In the image areas, the breakdown problem is more severe since the fields produced by the squeegee roller and by the latent image bearing surface add. The problem is most severe at the exit edge of the squeegee roller at which a meniscus is substantially not present.

In U.S. Pat. No. 4,684,238 an unmetered image is initially transferred to an intermediate transfer member and is then metered by a metering roller having a voltage opposite to the charge on the toner particles making up the image. No discussion of the problem of electrical breakdown is presented.

SUMMARY OF THE INVENTION

The present invention seeks to provide improved apparatus for image transfer.

There is thus provided in accordance with a preferred embodiment of the present invention an image bearing surface and an image receiving surface arranged for relative movement along a pathway whereby portions of the image bearing surface and the image receiving surface sequentially come into propinquity for image transfer therebetween and subsequently move out of propinquity following image transfer therebetween, potential impression means associated with at least one portion of at least one of the image bearing surface and the image receiving surface for impressing a potential on the at least one portion, and means for energizing the potential impression means only when the at least one portion is located at a predetermined location along the pathway, thereby to provide desired image transfer enhancement.

Further in accordance with a preferred embodiment of the present invention, the potential impression means includes a plurality of electrical conductors associated with at least one of the image bearing surface and the image receiving surface.

Still further in accordance with a preferred embodiment of the present invention, the potential impression means includes means for impressing a potential of a first polarity opposite to the polarity of the charge on the image particles.

Further in accordance with a preferred embodiment of the present invention, the potential impression means includes means for impressing a first potential on the at least one portion when the at least one portion is located at a first predetermined location and for impressing a second potential on the at least one portion when the at least one portion is located at a second predetermined location.

Still further in accordance with a preferred embodiment of the present invention, the potential impression means includes means for simultaneously impressing a first potential on a first portion of the at least one surface and a second potential on a second portion of the at least one surface.

Additionally in accordance with a preferred embodiment of the present invention, the potential impression means includes means for impressing a first potential on a first portion of the at least one surface when the first portion is located at a first predetermined location and for impressing a second potential on the first portion when the first portion is located at a second predetermined location and simultaneously impressing the second potential on the second portion when it is located at the second predetermined location and the first potential on the second portion when it is located at the first location.

Further in accordance with a preferred embodiment of the present invention, the potential impression means includes means for simultaneously impressing a first potential on a first portion of the at least one surface when the first portion is located at a first predetermined location and a second potential on a second portion of the at least one surface when the second portion is located at a second predetermined location, and means for simultaneously impressing the second potential on the first portion when the first portion is located at the second predetermined location and the first potential on a third portion when it is located at the first location.

Further in accordance with a preferred embodiment of the present invention, the first and second potentials are of opposite polarity.

Still further in accordance with a preferred embodiment of the present invention, the plurality of electrical conductors include first and second arrays of electrical conductors arranged on the image receiving surface and the means for electrically energizing include first means for selectably energizing at least one electrical conductor of the first array for providing a desired potential at a first predetermined location, and second means for selectably energizing at least one electrical conductor of the second array for providing desired heating of the image receiving surface at a second predetermined location.

Additionally in accordance with a preferred embodiment of the present invention, the apparatus for image transfer also includes means for removing excess liquid from the image bearing surface.

Further in accordance with a preferred embodiment of the present invention, the potential impression means provides a desired electrical field at a desired location for producing electrophoretic image transfer thereat.

Still further in accordance with a preferred embodiment of the present invention, energization of the electrical conductors provides desired resistance heating of the image just prior to transfer thereof.

Further in accordance with a preferred embodiment of the present invention, the image bearing surface is arranged to support a liquid toner image thereon, including image regions and background regions, and the apparatus for image transfer also includes means for removing pigmented toner particles from the background regions defined on the image bearing surface.

Additionally in accordance with a preferred embodiment of the present invention, the means for removing includes a roller with a potential intermediate that of the image regions and the background regions.

Additionally in accordance with a preferred embodiment of the present invention, the potential impression means includes means for impressing a potential of a first polarity, the same as that of the polarity of the charge on the image particles, on at least one conductor in a first region and for impressing a potential of a second polarity, opposite to to that of the polarity of the charge on the image particles, on at least one conductor in a second region.

Further in accordance with a preferred embodiment of the present invention, the plurality of electrical conductors include first and second arrays of electrical conductors arranged on the image receiving surface and the means for electrically energizing include first means for selectably energizing at least one electrical conductor of the first array for providing a desired potential at a first given location on the image receiving surface and second means for selectably energizing at least one electrical conductor of the second array for providing desired heating of the image receiving surface at a second given location.

Still further in accordance with a preferred embodiment of the present invention, the image transfer apparatus also includes second transfer means for image transfer from the image receiving surface to a substrate.

Throughout the specification and claims, the term "potential impression means" will be used in a very broad sense to mean any apparatus for applying an electrical potential which results in the presence of an electric field and thus, includes. inter alia, conductors, partially conducting dielectrics and other materials or devices which perform the indicated function.

Throughout the specification and claims, the terms "rigidization" and "compacting" will be used interchangeably to indicate an increase in cohesiveness of the image produced in accordance with the present invention.

BRIEF DESCRIPTION OF THE DRAWINGS

The present invention will be understood and appreciated more fully from the following detailed description, taken in conjunction with the drawings in which:

FIG. 8 is a simplified side view illustration of the arrangement of electrical supply apparatus in association with an intermediate transfer member;

FIG. 9 is a side view illustration taken along lines IX—IX in FIG. 8 for one embodiment of the invention;

DETAILED DESCRIPTION OF PREFERRED EMBODIMENTS

Figure 1:
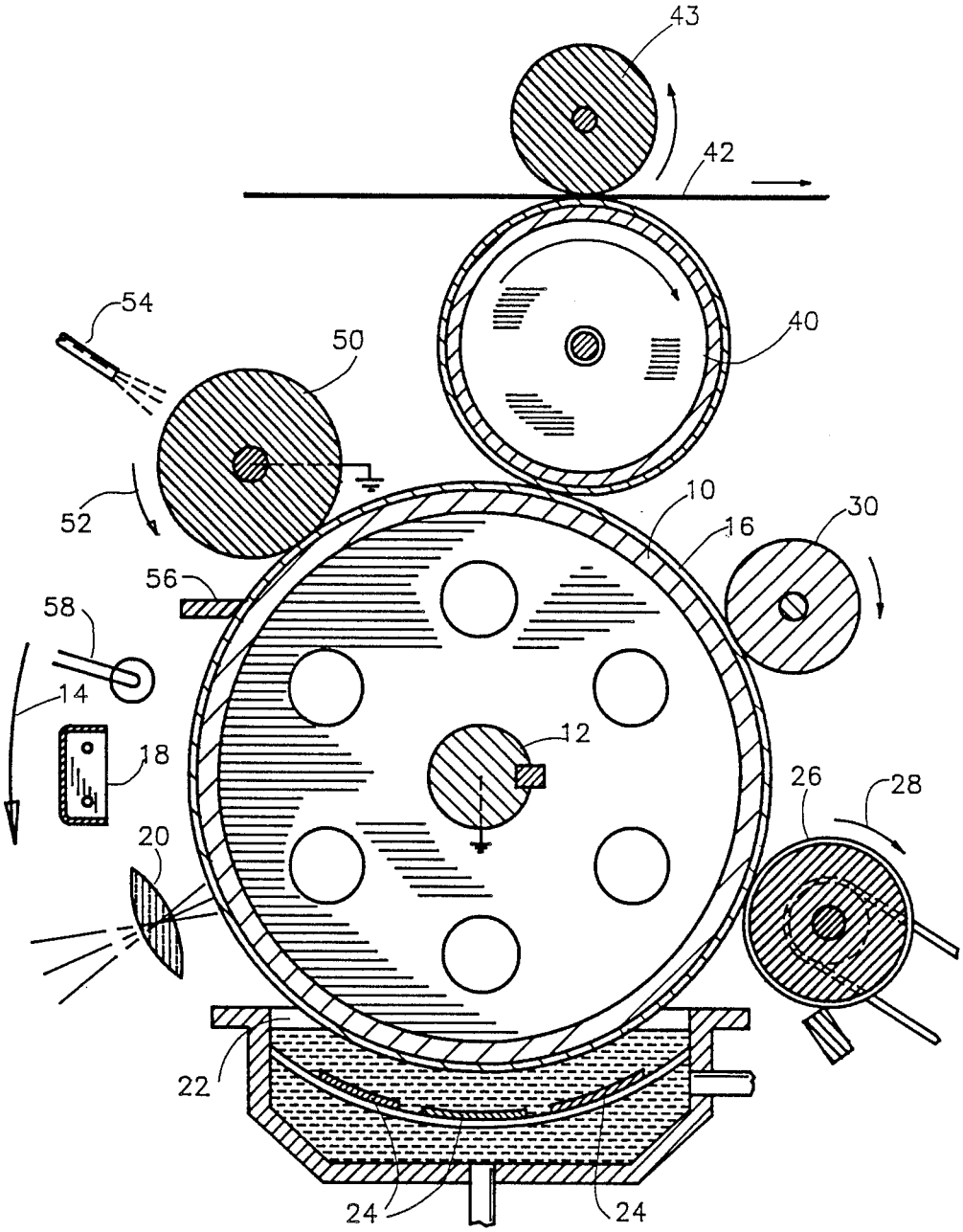
FIG. 1 is a simplified sectional illustration of electrophotographic apparatus constructed and operative in accordance with a preferred embodiment of the present invention.

Reference is now made to FIG. 1 which illustrates electrophotographic imaging apparatus constructed and operative in accordance with a preferred embodiment of the present invention. This and other embodiments of the invention are described for the case of liquid toner systems with negatively charged particles, and positively charged photoconductors. For positively charged toner, the polarities of the voltages given would be reversed.

In a preferred embodiment of the invention the toner of example 1 of U.S. Pat. No. 4,794,651 can be used, but a variety of liquid toner types are useful in the practice of the invention.

As in conventional electrophotographic systems, the apparatus of FIG. 1 comprises a drum 10 arranged for rotation about an axle 12 in a direction generally indicated by arrow 14. The drum 10 is formed with a cylindrical photoconductive surface 16.

A corona discharge device 18 is operative to generally uniformly charge the photoconductor surface 16 with a positive charge. Continued rotation of the drum 10 brings the charged photoconductor surface 16 into image receiving relationship with an exposure unit including a lens 20, which focuses a desired image onto the charged photoconductor surface 16, selectively discharging the photoconductor surface, thus producing an electrostatic latent image thereon.

Continued rotation of the drum 10 brings the charged photoconductor surface 16 bearing the electrostatic latent image into a development unit 22 including development electrodes 24, which is operative to apply a liquid toner to develop the electrostatic latent image.

In accordance with a preferred embodiment of the invention, following application of toner thereto, the photoconductor surface 16 passes a typically positively charged rotating roller 26, preferably rotating in a direction indicated by an arrow 28. Typically the spatial separation of the roller 26 from the photoconductor surface 16 is about 50 microns. Preferably the charge on roller 26 is intermediate the voltages of the latent image areas and of the background areas on the photoconductor surface. Typical voltages are: roller 26: 200 V, background area: 50 V and latent image areas: up to 1000 V.

It is appreciated that roller 26 may rotate in the direction opposite to that indicated by arrow 28 and function as a metering roller and reduce the thickness of liquid on the photoconductor surface 16.

Alternatively, the metering function may be eliminated at this stage or carried out downstream by an appropriate technique.

In any event, the liquid which passes the roller 26 should be relatively free of pigmented particles except in the region of the latent image.

Downstream of roller 26 there is preferably provided a rigidizing roller 30. The rigidizing roller 30 is preferably formed of a resilient polymeric material, such as conductive resilient polymeric materials as described in either or both of U.S. Pat. Nos. 3,959,574 and 3,863,603 and is preferably maintained in non-contacting spatial relationship with the photoconductive surface 16.

According to one embodiment of the invention, roller 30 is lightly urged against the photoconductive surface 16 as by a spring mounting (not shown). Rotation of the photoconductive surface 16 produces hydrodynamic forces on roller 30 which push it slightly away from the photoconductive surface 16, so that it typically lies at a separation of 15 microns from the photoconductive surface.

According to an alternative embodiment of the present invention, the roller 30 may be mounted at a fixed separation from photoconductive surface 16. In such a case, to take account of surface irregularities, the roller 30 lies at a separation of about 50 microns from the photoconductive surface. The surface of roller 30 typically moves in the same direction as the photoconductive surface so as not to substantially remove liquid from the image. Preferably the nip between the roller 30 and the photoconductive surface 16 is kept wet so as to minimize problems of electrical discharge. Various constructions of rigidizing rollers which reduce problems of electrical discharge are described hereinbelow.

In an embodiment of the invention, the biased squeegee described in U.S. Pat. No. 4,286,039, the disclosure of which is incorporated herein by reference, is used as the roller 30. A negative voltage of between several hundred to 2000 volts can be used and some breakdown is experienced. Roller 30 is negatively charged to a potential of at least several hundred and up to 2000 volts with the same sign as the charge on the pigmented toner particles, so that it repels similarly charged pigmented particles and causes them to more closely approach the image areas of the photoconductor surface 16, thus compressing and rigidizing the image.

Downstream of rigidizing roller 30 there is provided an intermediate transfer member 40, which rotates in a direction opposite to that of photoconductor surface 16, as shown by arrow 41, and is operative for receiving the toner image therefrom and for transferring the toner image to a receiving substrate 42, such as paper.

Various types of intermediate transfer members are known and are described, for example in U.S. Pat. No. 4,684,238 and in assignee's copending U.S. patent application entitled METHOD AND APPARATUS FOR IMAGING USING AN INTERMEDIATE TRANSFER MEMBER filed Jan. 4, 1989, the disclosures of which are incorporated herein by reference. Particularly beneficial constructions of intermediate transfer members in accordance with the present invention are described in detail hereinbelow.

Transfer of the image to intermediate transfer member 40 is preferably aided by providing electrification of the intermediate transfer member 40 to a voltage of polarity to that of the charged particles, although other methods known in art may be employed. Subsequent transfer of the image to substrate 42 is preferably aided by heat and pressure, although other methods known in the art may be employed.

It has been noted that when the negatively biased squeegee roller of U.S. Pat. No. 4,286,039, with high negative voltage, is utilized as the roller 30, the positive voltage on the intermediate transfer member required to transfer the image thereto is sharply reduced, typically from about 1000 volts or more to about 500 volts. It is believed that this reduction is possibly due to a discharge of the charges in the image area of the image bearing surface and a charging of the background areas of the image bearing surface.

Following transfer of the toner image to the intermediate transfer member, the photoconductive surface 16 is engaged by a cleaning roller 50, which typically rotates in a direction indicated by an arrow 52, such that its surface moves in a direction opposite to the movement of the adjacent photoconductive surface 16 which it operatively engages. The cleaning roller 50 is operative to scrub clean the surface 16. A cleaning material, such as toner, may be supplied to the cleaning roller 50, via a conduit 54. A wiper blade 56 completes the cleaning of the photoconductive surface. Any residual charge left on the photoconductive surface 16 is removed by flooding the photoconductor surface with light from a lamp 58.

Figure 2:
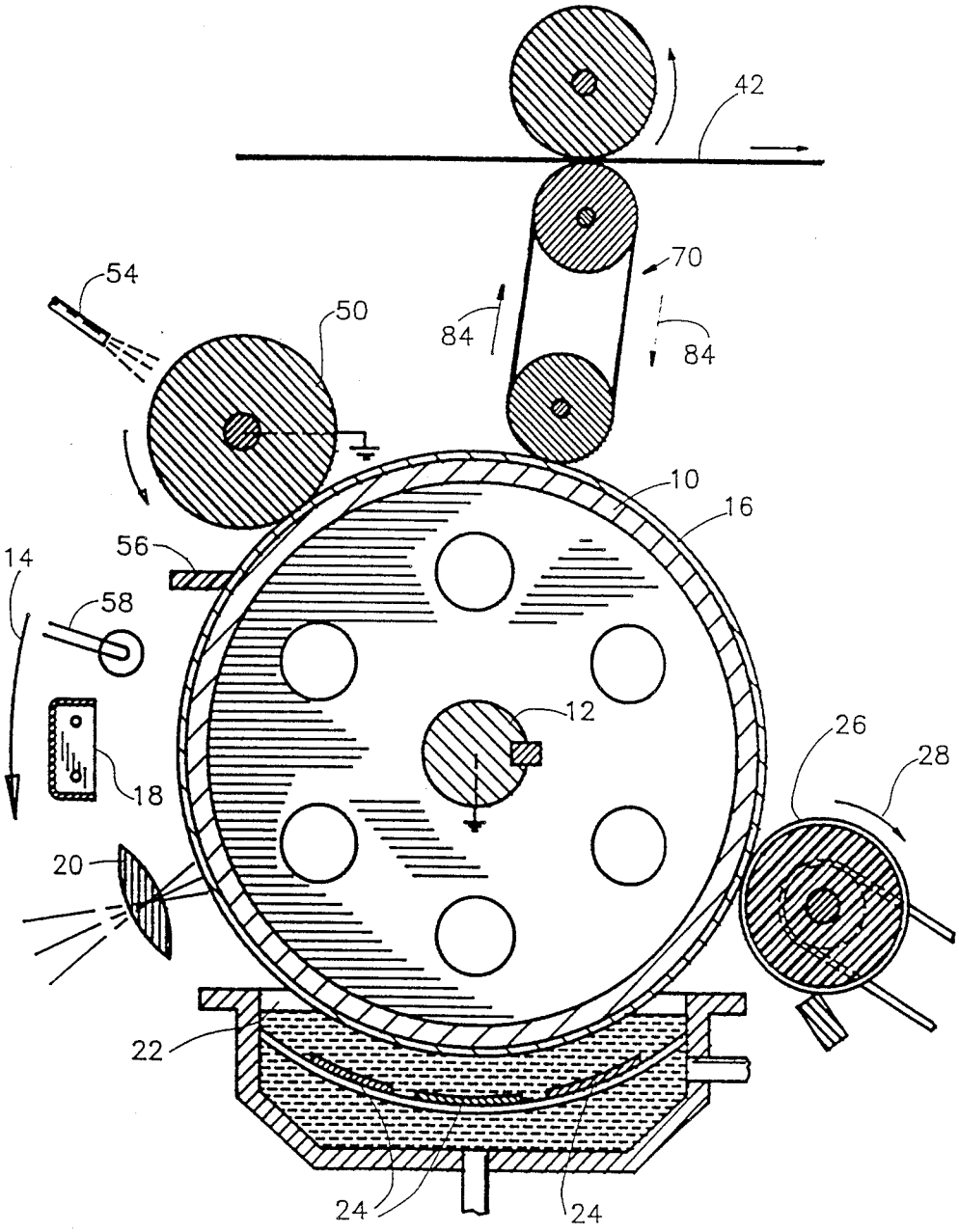
FIG. 2 is a simplified sectional illustration of electrophotographic apparatus constructed and operative in accordance with another preferred embodiment of the present invention.

Reference is now made to FIG. 2 which illustrates electrophotographic imaging apparatus constructed and operative in accordance with another preferred embodiment of the present invention. The apparatus of FIG. 2 shares many common elements with that of FIG. 1. These elements are indicated by identical reference numerals, and for the sake of conciseness are not described herein a second time.

The embodiment of FIG. 2 differs from that of FIG. 1 in that the rigidizing roller 30 is eliminated and further in that a belt-type, instead of roller type, intermediate transfer member 70 is employed. Belt-type intermediate transfer members are well known in the art and are described, inter alia, in U.S. Pat. Nos. 3,893,761; 4,684,238 and 4,690,539, the disclosures of which are incorporated herein by reference.

It will be appreciated that the belt-type intermediate transfer member may be employed in the apparatus of FIG. 1 and that the rigidizing roller 30 may be omitted in the embodiment of FIG. 1 or added to the embodiment of FIG. 2.

Intermediate transfer member 70 is preferably charged so as to provide electrophoretic transfer of the image from the photoconductive surface 16 thereto. Within given limits, the efficiency of electrophoretic transfer of the image can be enhanced by increasing the potential difference between the photoconductive surface 16 and the intermediate transfer member 70. Increase in the potential difference between the photoconductive surface 16 and the intermediate transfer member 70 is limited, however, by the danger of electrical breakdown, which increases with an increase in potential difference.

The interrelationship between the minimum voltage difference at which breakdown occurs across a gap and the gap separation is given by the well-known Paschen curve. In air, the minimum breakdown voltage for a gap between two surfaces typically occurs, for a gap separation of about 8 microns, at a voltage difference of about 360 V. The breakdown voltage increases significantly for gaps either smaller or larger than the indicated gap, and when dielectric liquids such as Isopar or liquid developer, are present in the gap.

In accordance with a preferred embodiment of the invention, means are provided for significantly reducing or eliminating electrical breakdown in the vicinity of the photoconductive surface 16, which breakdown could damage the photoconductive surface and/or the image. In this connection reference is made to FIGS. 3A and 3B, which illustrate conceptually an intermediate transfer member 40 having a limited charged region or regions.

Figure 3A:
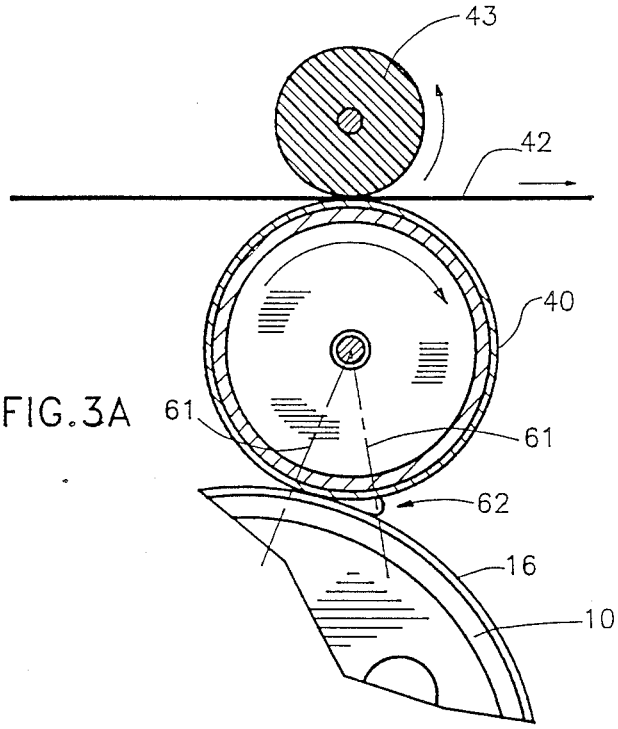
FIG. 3A is a simplified conceptual sectional illustration of image transfer apparatus constructed and operative in accordance with a preferred embodiment of the present invention.

FIG. 3A conceptually illustrates an intermediate transfer member 40 which is provided with an arrangement of electrical conductors whereby, at any given time, for any given rotational state of the intermediate transfer member, only an angularly delimited portion of the intermediate transfer member is energized to a sufficiently high voltage as to define a significant potential difference relative to the photoconductor surface 16.

In the illustrated embodiment, the energized portion, is selected so as to roughly correspond with the region of the nip 62 between the intermediate transfer member and the photoconductor surface 16. According to one embodiment of the invention the energized portion corresponds to the region which is filled with a liquid, which is delineated by adjacent radii 61, thus substantially reducing or eliminating electrical discharge thereat. According to a more generalized concept of the invention, the energized portion is not necessarily limited to the region filled with a liquid but is limited to a region in which the gap does not have a separation for which the breakdown voltage is less than the potential difference between the energized portion and the photoconductor surface 16, taking into account the nature of the material disposed in the gap. Even more generally, small amounts of breakdown may be allowed.

In the embodiment of FIG. 3A a voltage difference across the gap of 1000 V to 2000 V should be maintained for best results, although lesser or greater voltage differences may also be employed.

Figure 3B:
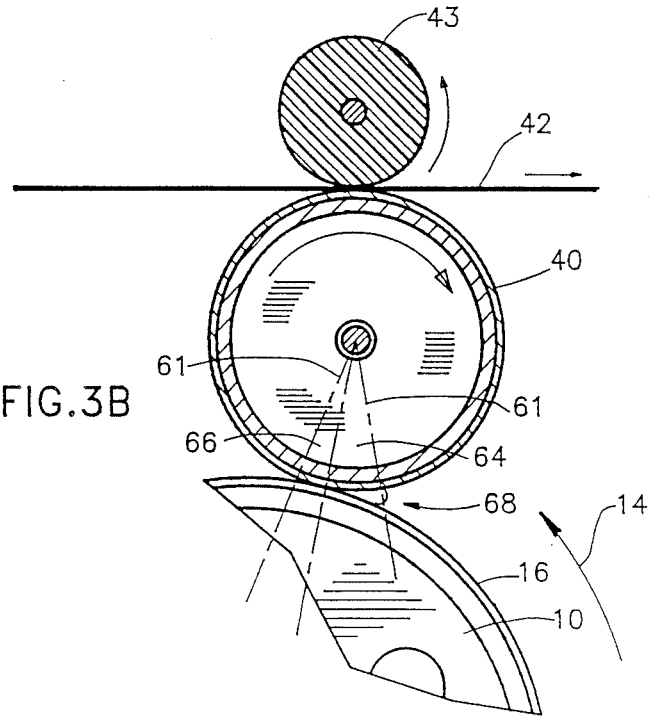
FIG. 3B is a simplified conceptual sectional illustration of image transfer apparatus constructed and operative in accordance with another preferred embodiment of the present invention.

FIG. 3B illustrates a further development of the structure illustrated in FIG. 3A. Here electrical voltages are supplied to the conductors in the intermediate transfer member 40 such that two different potentials are applied to the surface of the intermediate transfer member in adjacent regions 64 and 66 as illustrated.

This arrangement has particular utility in providing an intermediate transfer member 40 which serves both to rigidify the image prior to transfer and then to transfer the rigidified image from the photoconductor surface 16 to the intermediate transfer member 40.

In such an arrangement, where the pigmented particles are normally negatively charged the image areas on the photoconductor surface positively charged, and the directions of rotation of the photoconductor surface 16 and of the intermediate transfer member 40 as indicated in FIG. 3B, portion 64 will be energized to a negative potential, typically −200 V to −2000 V, to provide image compression or rigidization by urging the pigmented particles towards the image areas on the photoconductor surface, while portion 66 will be energized to a positive potential, typically +300 V to +2500 V, thus drawing the image electrophoretically from the photoconductor surface 16 through the solvent in the meniscus 68 onto the surface of intermediate transfer member 40 in portion 66. The lower positive voltage on portion 66 can be used for a relatively high negative voltage on portion 64.

One possible, but not definitive explanation of why good transfer is achieved with low positive voltage on portion 66 and high negative voltage on portion 64 is that charge transfer from the intermediate transfer member 40 to the photoconductive surface takes place, with subsequent at least partial neutralization of the charge on the drum.

Normally, between portions 66 and 64 there may be defined a region on the photoconductor surface of intermediate potential so as to prevent unwanted electrical discharge between portions 64 and 66. The outer boundaries of regions 64 and 66 are normally defined so as to avoid electrical breakdown between regions 64 and 66 and the photoconductor surface 16, as described above in connection with FIG. 3A.

Figure 4:
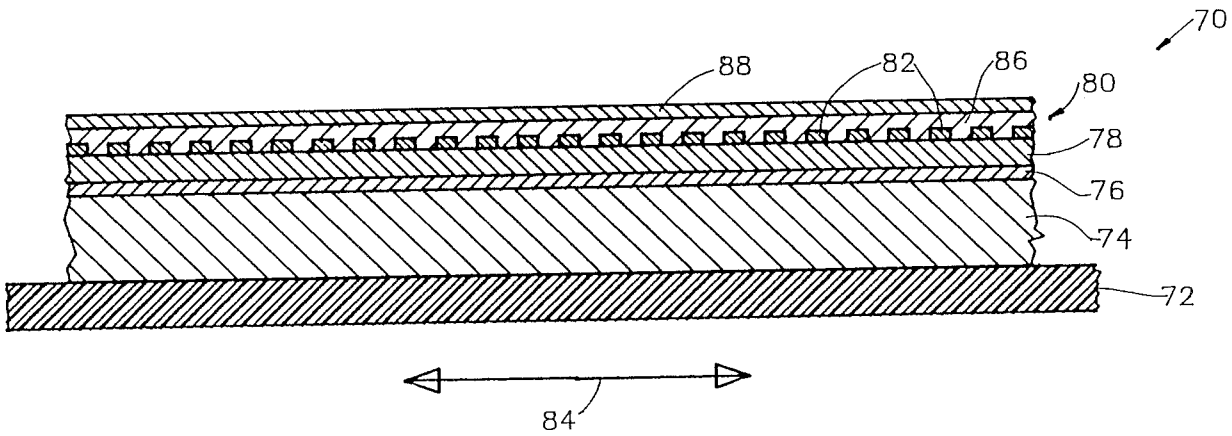
FIG. 4 is a simplified sectional illustration of part of an intermediate transfer member constructed and operative in accordance with a preferred embodiment of the present invention.

Reference is now made to FIG. 4, which is a signified and not necessarily to scale sectional illustration of an intermediate transfer member particularly useful in the apparatus shown in FIG. 2. The intermediate transfer member, generally indicated by reference numeral 70, typically comprises a high tensile strength substrate 72, such as Kapton, typically of thickness 10 microns, on which is preferably provided a resilient layer 74.

A resistive heating layer 76, typically formed of nickel-chrome alloy, is preferably formed onto resilient layer 74 and is coupled to a source of electrical current for providing desired heating of the intermediate transfer member 70 to assist in image transfer therefrom onto an image receiving substrate. Disposed over heating layer 76 is an insulative layer 78, typically formed of polyurethane of thickness 5 microns.

Supported on insulative layer 78 is a generally parallel array 80 of generally uniformly spaced selectably energizable electrical conductors 82. The elongate axes of the conductors 82 are generally perpendicular to the direction of movement indicated by arrow 84 of the intermediate transfer member 70 when in operation, as shown, for example, in FIG. 2.

Conductors 82 are typically of thickness 35 microns and of width 500 microns and are separated by 250 microns. They are typically embedded in a layer 86 of conductive material, such as a silicone-polyurethane copolymer loaded with 2% Degussa Printex XE-2, manufactured by Degussa AG of Frankfurt. West Germany, having a thickness about 100 microns over the conductors 82 and a resistivity of about $10^{+5}$ ohm-cm. Disposed over layer 86 is a release layer 88, such as Syl-Off manufactured by Dow Corning, and having a typical thickness of 10 microns.

Figure 5:
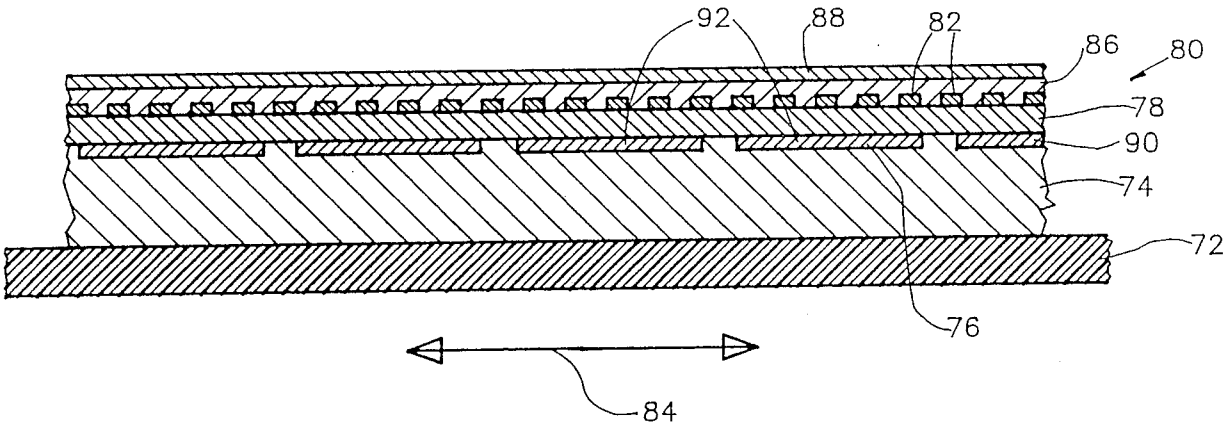
FIG. 5 is a simplified sectional illustration of part of an intermediate transfer member constructed and operative in accordance with a preferred embodiment of the present invention.

Reference is now made to FIG. 5, which illustrates an intermediate transfer member which is identical to that shown in FIG. 4 except that the resistive heating layer 76 is not continuous but is rather formed of a generally parallel array 90 of generally uniformly spaced selectably energizable electrical conductors 92. The elongate axes of the conductors 92 are generally perpendicular to the direction of movement indicated by arrow 84 of the intermediate transfer member 70 when in operation as shown. For example, in FIG. 2.

The provision of array 90 instead of a continuous resistive heating area permits the heating of the intermediate transfer member 70 to be spatially selective, for example, to permit heating of the intermediate transfer member only along that portion of its route which extends from the photoconductor surface 16 to the substrate 42 (FIG. 2).

Heating of the image carried on the intermediate transfer member 70 along this portion of its route enables enhancement of the cohesiveness of the image to be realized without possible heat damage to the photoconductor surface 16 as described in Assignee's copending U.S. patent application 272,323 filed Nov. 21, 1988, the disclosure of which is incorporated herein by reference, and also permits heating of the image to be terminated with a desired level of precision to enhance transfer of the image from the intermediate transfer member to the substrate. Enhancement of image transfer in this manner is described and claimed in Assignee's copending U.S. patent application filed Jan. 4, 1989 and entitled Method & Apparatus for Imaging Using an Intermediate Transfer Member, the teaching of which is hereby incorporated herein by reference.

This selective heating will be most effective if the heat capacity of the intermediate transfer member is relatively low, so that the heating and cooling can occur as described in the above-identified U.S. patent application.

It will be appreciated that although the intermediate transfer members having one or more arrays of selectably energizable conductors have been described and shown in FIGS. 4 and 5 in the context of belts, the structure thereof may be applied equally to intermediate transfer members in the form of rollers, such as those employed in the apparatus of FIG. 1. In addition, some of the layers of the structures of FIGS. 4 and 5 can be omitted, as may be appropriate if, for example, heating is not desired.

Figure 6:
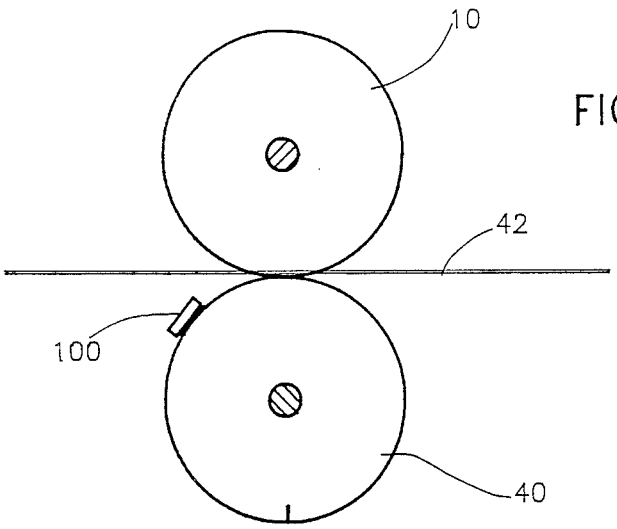
FIG. 6 is an illustration of part of the apparatus of FIG. 3A and illustrating the supply of potential to the intermediate transfer member.
Figure 7:
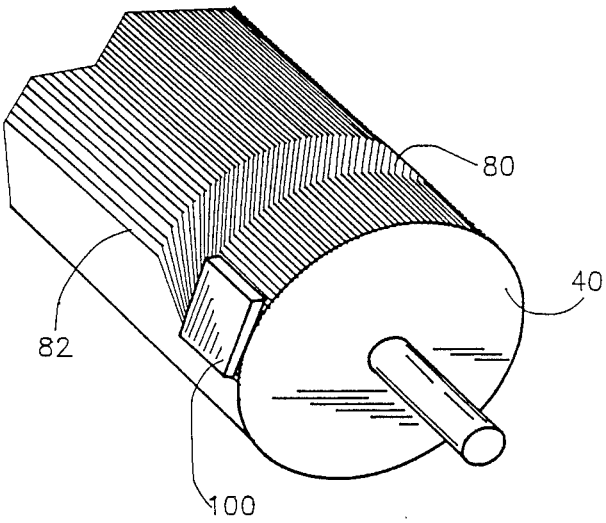
FIG. 7 is a pictorial illustration of the arrangement of conductors on the intermediate transfer member employed in the apparatus of FIG. 6.

Reference is now made to FIGS. 6–10, which illustrate the use of selectably energizable conductors in roller configurations. FIGS. 6 and 7 illustrate an intermediate transfer member roller 40 having at least one array 80 of selectably energizable conductors in operative engagement with a substrate 42 and a drum 10. An electrical energizing shoe 100 applies electrical power to the array 80. The shoe 100 may comprise one or more brushes or contacts contacting one or more groups of conductors.

FIG. 7 illustrates a preferred arrangement of the array 80 on a roller 40. It is seen that the conductors 82 are circumferentially offset adjacent the edge of the roller 40. The purpose of this offset is to enable energizing shoe 100 to be located outside of the nip between roller 40 and drum 10 yet nevertheless apply a desired voltage to the conductors 82 located in the nip for enhancing transfer thereat while minimizing electrical breakdown as described hereinabove.

Figure 10:
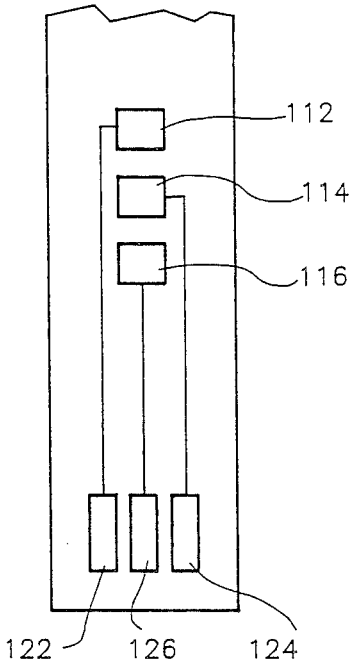
FIG. 10 is a simplified illustration of electrical supply apparatus useful in the arrangement of FIG. 8.

FIG. 8 illustrates an arrangement by which a shoe assembly of the type illustrated in FIG. 10 may be mounted in tension in operative engagement with a roller 92. The roller 92 is similar to roller 40, illustrated in FIG. 7, except that the conductors 82 no longer are required to be offset as shown in FIG. 7. The shoe assembly is held in tensioned contact with roller 92 and contacts 112, 114 and 116 of a shoe 110 (FIG. 10) are in contact with the extremities of conductors 82. The diameter of drum 10 is reduced at a region facing the extremities of conductors 82, as shown in FIG. 9, to provide clearance of shoe 110.

Accordingly, as seen in FIG. 10, shoe portion 112 may be maintained at −2000 Volts, shoe portion 114 may be maintained at 0 Volts and shoe portion 116 may be maintained at +500 Volts. An electrical connector 120 (shown in FIG. 8) may provide the desired voltages to respective connectors 122,124 and 126 which are electrically coupled to shoe portions 112, 114 and 116 respectively.

It may be appreciated that an intermediate transfer member of the type illustrated in FIG. 5, having two arrays 80 and 90 of conductors, may receive electrical power via shoe assemblies 110 arranged at opposite ends of the roller 92, as illustrated in FIG. 9.

Figure 11:
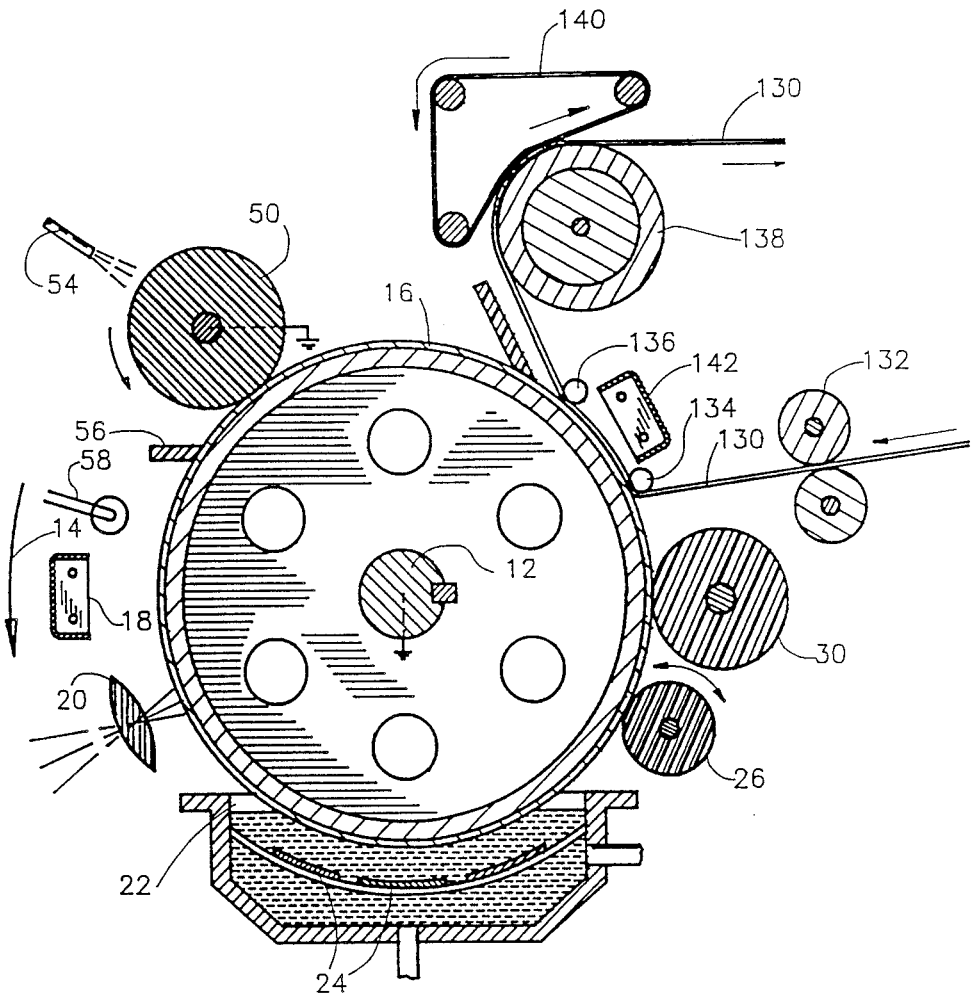
FIG. 11 is a simplified sectional illustration of electrophotographic apparatus constructed and operative in accordance with another preferred embodiment of the present invention.

Reference is now made to FIG. 11, which illustrates electrophotographic imaging apparatus generally similar to that shown in FIG. 1 with the following principal exception: the use of an intermediate transfer member is abandoned in favor of direct transfer from the photoconductor surface 16 to a substrate 130, such as paper. The direct transfer is effected by the provision of guide rollers 132, 134 and 136, which guide a continuous web of substrate 130, and a drive roller 138, which cooperates with a support web 140. A suitable charging device, such as a corona discharge device 142, charges the substrate at a transfer location, for effecting electrophoretic transfer of the image from the photoconductor surface 16 to the substrate 130.

According to a preferred embodiment of the invention, the apparatus of FIGS. 1 or 11 may be constructed and operative with a rigidizing roller 30 (FIG. 1, 11–13) which includes a generally parallel array 150 of generally uniformly spaced selectably energizable electrical conductors 152. The elongate axes of the conductors 152 are generally perpendicular to the direction of movement of the rigidizing roller 30 in operation as shown, for example, in FIG. 12. wherein the motion of the rigidizing roller is indicated by an arrow 154.

Conductors 152 are typically of thickness 35 microns and of width 500 microns and are separated by 250 microns. There is defined a general region 155 between the rigidizing roller 30 and the photoconductor surface 16, delimited by imaginary radii 156, in which the chance of electrical breakdown is low due to the presence thereat of a meniscus of the dielectric toner carrier. In this region conductors 152 are charged to a voltage of the same polarity as that of the pigmented toner particles, typically −500 to −2000 Volts when negatively charged toner particles are utilized. This arrangement compresses the toner particles of the image, thus rigidizing the image on the photoconductor surface, for resulting enhancement of transfer therefrom. It should be understood that the roller 30 of FIG. 12 can also act as a squeegee roller, substantially removing most of the liquid from the image and further physically compressing the image.

Figure 13:
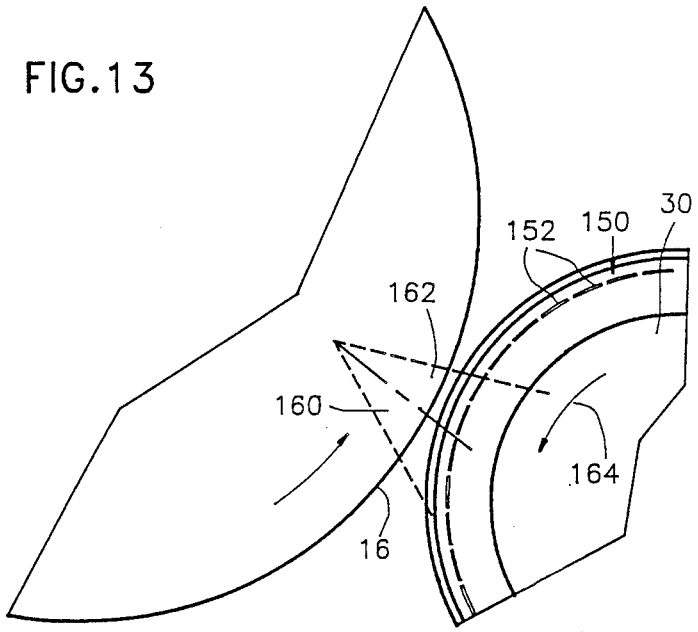
FIG. 13 is a simplified conceptual sectional illustration of image rigidization apparatus constructed and operative in accordance with another preferred embodiment of the present invention.
Figure 12:
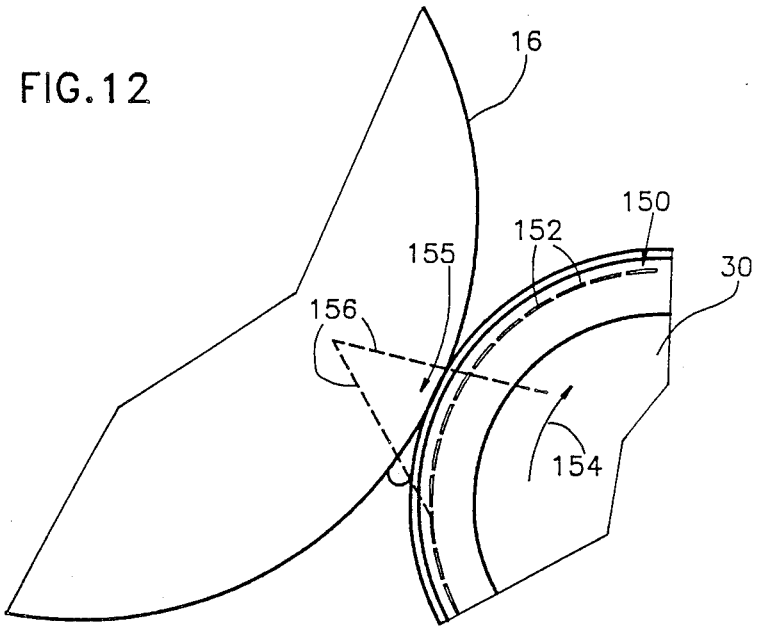
FIG. 12 is a simplified conceptual sectional illustration of image rigidization apparatus constructed and operative in accordance with a preferred embodiment of the present invention.

FIG. 13 illustrates a further development of the apparatus of FIG. 12 in which roller 30 serves as a metering, background removal and rigidizing roller. In this arrangement, two regions 160 and 162 are defined and opposite voltages are applied to the conductors 152 in those regions much in the same way as described above and illustrated in FIG. 3B.

This arrangement has particular utility in providing a background removal and rigidifying roller 30 which serves both to remove background from the image and to rigidify the image prior to transfer.

In such an arrangement, where the pigmented particles are normally negatively charged and the image areas on the photoconductor surface are positively charged, and the directions of rotation of the photoconductor surface 16 and of the roller 30 which is spaced from surface 16, are as indicated in FIG. 13, region 160 will be energized to a positive potential, typically +200 Volts, to draw pigmented particles away from the background areas of the photoconductor surface 16. Region 162 will be energized to a negative potential, typically −200 V to −2000 V, to provide image rigidization by urging the pigmented particles towards the image areas on the photoconductor surface.

Normally, between regions 160 and 162 there may be a region on the roller 30 of intermediate potential, so as to prevent unwanted electrical discharge between regions 160 and 162. The outer boundary, of region 162 will normally be defined so as to avoid electrical breakdown between region 162 and the photoconductor surface 16.

Metering of excess liquid from the photoconductive surface 16 is achieved by counter rotation of roller 30 in a direction indicated by an arrow 164, as is well known in the art.

Figure 14:
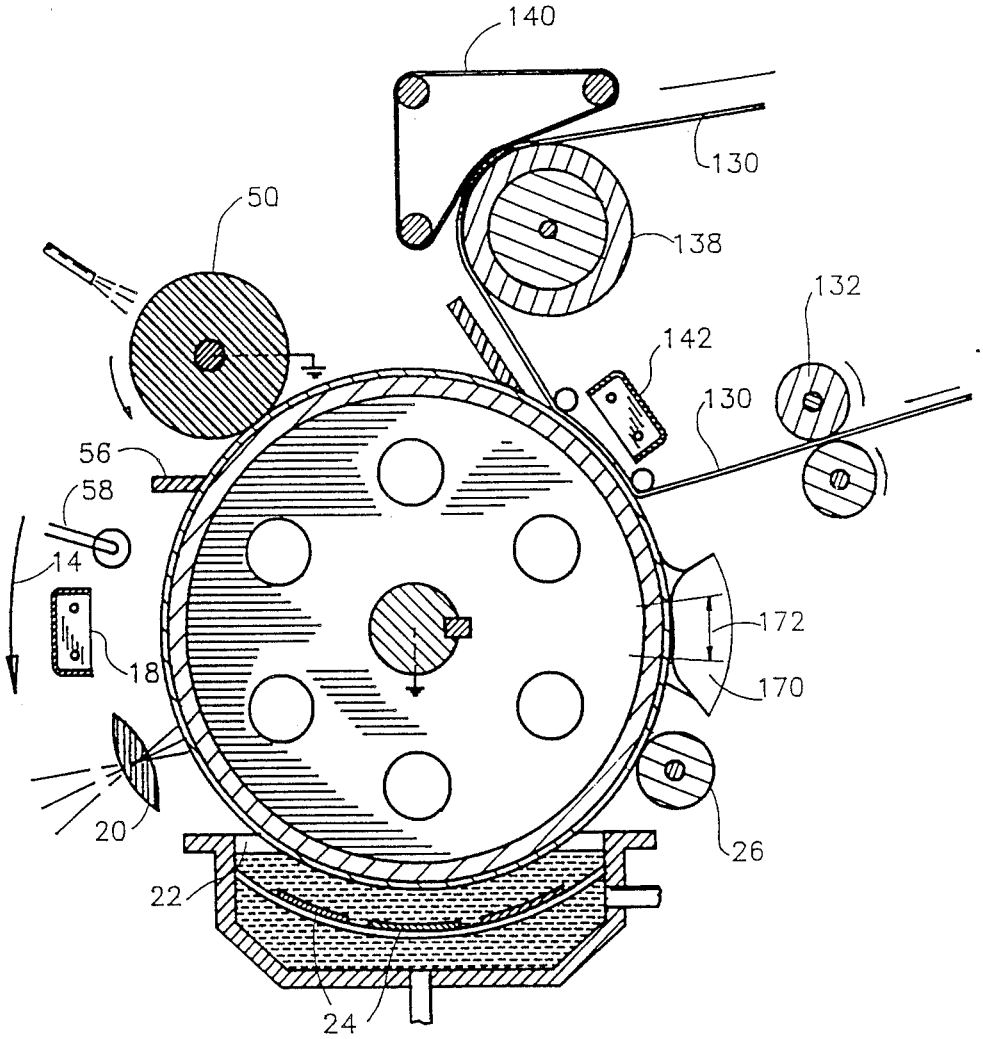
FIG. 14 is a simplified sectional illustration of electrophotographic apparatus constructed and operative in accordance with yet another preferred embodiment of the present invention.

Reference is now made to FIG. 14 which illustrates electrophotographic imaging apparatus which is substantially similar to that illustrated in FIG. 11 with the following exception; roller 30 is replaced by a non-rotating rigidizing element 170 having an electrically charged region 172 which is located interiorly of the edges of element 170, such that electrical breakdown is prevented.

Region 172 is selected such that the gap separation between the element 170 and the photoconductor surface 16 is such that when the gap is filled with dielectric toner carrier liquid during operation, no electrical discharge takes place at the operating voltages, which are preferably in the range of −200 to −2000 Volts for the element 170 within region 172, when the photoconductor surface 16 is charged to 1000 Volts at the image region and 50 Volts at the background region. The rigidizing element is preferably hydrodynamically shaped so that rotation of the roller will cause it to be spaced about 15 microns from the surface of the photoconductor, when it is lightly urged towards the photoconductor. Alternatively it may be kept at a fixed spacing from the photoconductor of the order of 50 microns.

Alternatively, a larger portion of the element 170 can be electrified, and the upstream end to the element shaped to provide a meniscus of insulating carrier liquid, until the spacing in air of the element 170 and the photoconductor are large enough to prevent breakdown or corona.

It will be appreciated that the signs of the various voltages have been given for an example using negatively charged toner particles. The invention is equally applicable to the use of positively charged toner particles with a negatively charged photoconductor, appropriate changes being made in the signs of the stated voltages.

It will be appreciated by persons skilled in the art that the present invention is not limited by what has been particularly shown and described hereinabove. Rather the scope of the present invention is defined only by the claims which follow:

We claim:

1. Apparatus for image transfer comprising:

an image bearing surface having charged image particles thereon, and an image receiving member comprising an elastic outer layer having at least one ply of elastic material defining an outer image receiving surface arranged for relative movement along a pathway whereby regions of the image bearing surface and the image receiving surface sequentially come into propinquity for image transfer therebetween and subsequently move out of propinquity following image transfer therebetween;

potential impression means contained within at least one portion of said elastic outer layer for impressing a potential between said at least one portion and said image bearing surface; and means for energizing said potential impression means only when said at least one portion is located at a predetermined location along said pathway, thereby to provide desired image transfer enhancement.

2. Apparatus according to claim 1 wherein said potential impression means comprises a plurality of electrical conductors.

3. Apparatus according to claim 1 wherein said potential impression means comprises means for impressing a potential of a first polarity opposite to the polarity of the charge on the image particles.

4. Apparatus according to claim 1 wherein said potential impression means comprises means for impressing a first potential on said at least one portion when said at least one portion is located at a first predetermined location and for impressing a second potential on said at least one portion when said at least one portion is located at a second predetermined location adjacent said first predetermined location.

5. Apparatus according to claim 1 and wherein said potential impression means comprises means for simultaneously impressing a first potential on a first portion of said at least one surface and a second potential on a second portion of said at least one surface adjacent said first portion.

6. Apparatus according to claim 1 and wherein said potential impression means comprises means for impressing a first potential on a first portion of said at least one surface when said first portion is located at a first predetermined location and for impressing a second potential on said first portion when said first portion is located at a second predetermined location adjacent said first predetermined location and simultaneously impressing said second potential on said second portion when it is located at said second predetermined location and said first potential on said second portion when it is located at said first location.

7. Apparatus according to claim 1 and wherein said potential impression means comprises:

means for simultaneously impressing a first potential on a first portion of said at least one surface when said first portion is located at a first predetermined location and a second potential on a second portion of said at least one surface when said second portion is located at a second predetermined location adjacent said first predetermined location; and means for simultaneously impressing said second potential on said first portion when said first portion is located at said second predetermined location and said first potential on a third portion when it is located at said first location.

8. Apparatus according to claim 5 and wherein said first and second potentials are of opposite polarity.

9. Apparatus according to claim 6 and wherein said first and second potentials are of opposite polarity.

10. Apparatus according to claim 7 and wherein said first are second potentials are of opposite polarity.

11. Apparatus according to claim 2 and wherein said plurality of electrical conductors comprise first and second arrays of electrical conductors arranged on said image receiving surface and said means for electrically energizing comprise:

first means for selectably energizing at least one electrical conductor of said first array for providing a desired potential at a first predetermined location; and second means for selectably energizing at least one electrical conductor of said second array for providing desired heating of said image receiving surface at a second predetermined location.

12. Apparatus according to claim 1 and also comprising means for removing excess liquid from the image bearing surface.

13. Apparatus according to claim 1 and wherein said potential impression means provides a desired electrical field at a desired location for producing electrophoretic image transfer thereat.

14. Apparatus according to claim 11 and wherein said apparatus also comprises means for subsequently transferring said image from said image receiving member and wherein energization of said at least one conductor of said second array provides desired resistance heating of the image prior to said subsequent transfer.

15. Apparatus according to claim 1 wherein said image bearing surface is arranged to support a liquid toner image thereon, comprising image regions and background regions, said apparatus comprising:

means for removing pigmented toner particles from the background regions defined on the image bearing surface.

16. Apparatus according to claim 15 wherein said means for removing comprises a roller with a potential intermediate that of the image regions and the background regions.

17. Apparatus according to claim 2 wherein said potential impression means comprises means for impressing a potential of a first polarity, the same as that of the polarity of the charge on the image particles, on at least one conductor in a first region and for impressing a potential of a second polarity, opposite to to that of the polarity of the charge on the image particles, on at least one conductor in a second region adjacent said first region to provide image transfer to said image receiving member at said first region and image rigidization at said second region.

18. Apparatus according to claim 17 and wherein said plurality of electrical conductors comprise first and second arrays of electrical conductors arranged on said image receiving surface and said means for electrically energizing comprise:

first means for selectably energizing at least one electrical conductor of said first array for providing a desired potential at a first given location on said image receiving surface; and second means for selectably energizing at least one electrical conductor of said second array for providing desired heating of said image receiving surface at a second given location.

19. Apparatus according to claim 1 and also comprising second transfer means for image transfer from said image receiving surface to a substrate.

20. Apparatus for image transfer comprising:

an image bearing surface and an image receiving surface arranged for relative movement along a pathway whereby regions of the image bearing surface and the image receiving surface sequentially come into propinquity for image transfer therebetween and subsequently move out of propinquity following image transfer therebetween;

potential impression means associated with at least one portion of at least one of the image bearing surface and the image receiving surface for simultaneously impressing a first potential on a first portion of said at least one surface and a second potential on an adjacent second portion of said at least one surface; and means for energizing said potential impression means to impress said first potential only when said first portion is located at a predetermined location along said pathway, thereby to provide desired image transfer enhancement along said first portion and simultaneously image rigidization along said adjacent second portion.

21. Apparatus according to claim 1 wherein said at least one ply of elastic material comprises at least two plies of elastic material and wherein said potential impression means is located between said two plies 22. Apparatus according to claim 1, wherein said propinquity includes touching engagement.

23. Apparatus according to claim 20, wherein said propinquity includes touching engagement.

24. Apparatus for image transfer comprising:

an image bearing surface;

an image receiving member comprising an outer layer defining an outer image receiving surface, arranged for relative movement along a pathway whereby regions of the image receiving surface and the image bearing surface come into propinquity for image transfer therebetween and subsequently move out of propinquity following image transfer therebetween;

electrical potential impression means contained within said outer layer comprising a plurality of electrical conductors;

means for energizing said electrical potential impression means to provide improved image transfer from said image bearing surface to said image receiving surface; and means for subsequently transferring said image to a final substrate.

25. Apparatus according to claim 26 wherein said plurality of electrical conductors comprise first and second arrays of electrical conductors and said means for energizing comprises:

first means for energizing at least one electrical conductor of said first array for providing a desired potential at a first predetermined location; and second means for energizing at least one conductor of said second array for providing desired heating of said image receiving surface.

26. Apparatus for transferring an image comprising:

an image bearing surface;

an image receiving member comprising an outer layer defining an outer image receiving surface, arranged for relative movement along a pathway whereby regions of the image receiving surface and the image bearing surface come into propinquity for image transfer therebetween and subsequently move out of propinquity following image transfer therebetween;

potential impression means associated with one of said image bearing and image receiving surfaces for simultaneously impressing a first potential of a given polarity on a first portion of said at least one surface and a second potential of a given polarity on an adjacent second portion of said at least one surface; and means for energizing said potential impression means to impress said first potential only when said first portion is located at a predetermined location along said pathway, to provide desired image transfer enhancement along said first portion and simultaneous image rigidization along said adjacent second portion.

27. Apparatus according to claim 26 wherein said outer layer comprises an elastic outer layer having at least one ply of elastic material.

28. Apparatus according to claim 26 wherein said potential impression means is contained within said outer layer.

29. Apparatus according to claim 26 wherein said potential impression means comprises a plurality of electrical conductors.

30. Apparatus according to claim 26 and wherein said first and second potentials are of opposite polarity.

31. Apparatus according to claim 26 wherein said image bearing surface is arranged to support a liquid toner image thereon, comprising image regions and background regions, said apparatus comprising:

means for removing pigmented toner particles from the background regions defined on the image bearing surface.

32. Apparatus according to claim 26 wherein said image is a liquid toner image comprising carrier liquid and charged toner particles and wherein the polarity of said first potential is the same as the polarity of the toner particles, and the polarity of said second potential is opposite the polarity of the toner particles.

33. Apparatus according to claim 26 and also comprising second transfer means for image transfer from said image receiving surface to a substrate.

34. Apparatus according to claim 27 wherein said at least one ply of elastic material comprises at least two plies of elastic material and wherein said potential impression means is placed between said two plies.

35. Apparatus according to claim 24, wherein said propinquity includes touching engagement.

36. Apparatus according to claim 26, wherein said propinquity includes touching engagement.

* * * * *

UNITED STATES PATENT AND TRADEMARK OFFICE

CERTIFICATE OF CORRECTION

PATENT NO. : 4,984,025

DATED : January 8, 1991

INVENTOR(S) : B. LANDA et al.

It is certified that error appears in the above-identified patent and that said Letters Patent is hereby corrected as shown below:

At column 1, line 47, after "Pat" insert ---.---.
At column 2, line 18, delete "of". insert --the--.
At column 7, line 14, after "polarity" insert --- opposite---.
At column 8, line 39, after "invention" insert ---,---.

At column 8, line 61, after "66" insert ---,---.
At column 8, line 68, after "charged" insert ---,---.
At column 9, line 25, after "potential" insert ---,---.
At column 9, line 59, change "." to ---,---.
At column 10, line 6, change ". For" to ---, for---.
At column 11, line 52, after "region" insert ---,---.
At column 11, line 68, after "regions" insert ---,---.
At column 12, line 21, delete ",".
At column 14, line 8 (claim 10, line 2), change "are" to ---and---.
At column 14, line 52 (claim 17, line 6), delete "to" (second occurrence).

Signed and Sealed this

Twenty-ninth Day of June, 1993

Michael K. Kirk

*Attest:*

MICHAEL K. KIRK

*Attesting Officer*

*Acting Commissioner of Patents and Trademarks*